US006781550B1

(12) United States Patent
Shoji et al.

(10) Patent No.: US 6,781,550 B1
(45) Date of Patent: Aug. 24, 2004

(54) ANTENNA DEVICE AND PORTABLE DEVICE

(75) Inventors: Hideaki Shoji, Hyogo (JP); Yasuhito Imanishi, Hyogo (JP); Toru Fukasawa, Hyogo (JP); Hiroyuki Ohmine, Hyogo (JP)

(73) Assignee: Mitsubishi Denki Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/148,402

(22) PCT Filed: Nov. 6, 2000

(86) PCT No.: PCT/JP00/07798

§ 371 (c)(1),
(2), (4) Date: May 30, 2002

(87) PCT Pub. No.: WO02/37602

PCT Pub. Date: May 10, 2002

(51) Int. Cl.[7] ..... H01Q 1/24
(52) U.S. Cl. ..... 343/702; 343/900
(58) Field of Search ..... 343/702, 900

(56) References Cited

U.S. PATENT DOCUMENTS 5,072,230 A * 12/1991 Taniyoshi et al. ..... 343/715
5,302,963 A * 4/1994 Wiggenhorn ..... 343/901
6,166,697 A * 12/2000 Granqvist et al. ..... 343/702

FOREIGN PATENT DOCUMENTS

| | | |
|---|---|---|
| JP | 8-288725 | 11/1996 |
| JP | 09-270839 | 10/1997 |
| JP | 09-307325 | 11/1997 |
| JP | 11-017426 | 1/1999 |
| JP | 11-068437 | 3/1999 |

* cited by examiner

*Primary Examiner*—James Clinger
(74) *Attorney, Agent, or Firm*—Oblon, Spivak, McClelland, Maier & Neustadt, P.C.

(57) ABSTRACT

The antenna device includes a linear antenna (2, 11, 15), a fixing member (7), and a power feed member (10, 12, 14). The fixing member (7) is formed from a dielectric, and holds a portion (11) of the antenna. The power feed member (12, 10) contacts the antenna (11, 15). The fixing member (7) holds the antenna (2, 11, 15) in a movable manner.

11 Claims, 12 Drawing Sheets

ANTENNA DEVICE AND PORTABLE DEVICE

TECHNICAL FIELD

The present invention relates to an antenna device and a portable equipment, and more particularly, relates to an antenna device capable of preventing degradation in antenna gain during a call, and a portable equipment using the same.

BACKGROUND ART

Recently, mobile phones are increasingly becoming widespread. FIG. 17 is a schematic diagram of a conventional mobile phone, and FIG. 18 shows a schematic cross-sectional view taken along line XVIII—XVIII of FIG. 17 and a schematic graph of a current distribution in an antenna. The conventional mobile phone will now be described with reference to FIGS. 17 and 18.

Referring to FIGS. 17 and 18, a conventional mobile phone 101 includes in its main body a liquid crystal display portion 105, operation keys 106 for inputting a telephone number and the like, a speaker 104 and a microphone 103 for listening and speaking over the phone, respectively, and an antenna for communication with a base station. The antenna, which is formed from a non-retracted antenna 151 and a linear extension antenna 102, is retractable in the main body of mobile phone 101. FIGS. 17 and 18 show the state where the antenna is retracted in the main body of mobile phone 101. As shown in FIGS. 17 and 18, when the antenna is retracted in main body 108 of mobile phone 101, non-retracted antenna 151 sticks out of main body 108, and extension antenna 102 is accommodated within main body 108. On the other hand, when mobile phone 101 is used for a phone call or the like, the antenna is stretched out of main body 108 of mobile phone 101 as shown in FIG. 19 so that extension antenna 102 is exposed outside main body 108. FIG. 19 shows a schematic cross sectional view of the state where the antenna is stretched out of the main body of the mobile phone of FIG. 17 and a schematic graph of a current distribution in the antenna. FIG. 19 corresponds to FIG. 18.

Referring to FIGS. 18 and 19, the mobile phone includes a metal boss 150 in order to fix the antenna formed from non-retracted antenna 151 and linear extension antenna 102 to main body 108 in a stretchable manner. Metal boss 150 is a cylindrical boss having a hole, and the antenna is slidably inserted into the hole. When the antenna is retracted as shown in FIG. 18, the antenna is fixed by contact between the sidewall of the hole in metal boss 150 and the surface of the region of the antenna that is located under non-retracted antenna 151. When the antenna is stretched as shown in FIG. 19, the antenna is fixed by contact between the sidewall of the hole in metal boss 150 and the surface of an antenna end 111 located at the end of the antenna.

Metal boss 150 is fixed to a housing of main body 108 of mobile phone 101, and the like. Main body 105 of mobile phone 101 accommodates therein a circuit substrate 109 having transmitting/receiving circuit elements arranged thereon. A power feed pin 110 is mounted on the surface of circuit substrate 109. Power feed pin 110 contacts the outer peripheral surface of metal boss 150.

When the antenna is retracted as shown in FIGS. 17 and 18, the circuit elements formed on circuit substrate 109 are electrically connected to non-retracted antenna 151 through power feed pin 110, metal boss 150 and the region of the antenna that is located under non-retracted antenna 151. Moreover, when the antenna is stretched as shown in FIG. 19, the circuit elements formed on circuit substrate 109 are electrically connected to extension antenna 102 through power feed pin 110, metal boss 150 and antenna end 111.

However, the conventional mobile phone of FIGS. 17 to 19 has the following problems.

Since metal boss 150 contacting the antenna is also a conductor, it acts as if it were a part of antenna when the antenna transmits and receives radio waves. For example, when a current flows through non-retracted antenna 151 of FIG. 18 (e.g., when non-retracted antenna 151 receives radio waves), it flows not only through non-retracted antenna 151 but also through metal boss 150. Moreover, when extension antenna 102 of FIG. 19 transmits and receives radio waves, a current flows not only through extension antenna 102 but also through metal boss 150. In other words, due to the presence of metal boss 150, non-retracted antenna 151 and extension antenna 102 act as if they were an antenna having an electrically discontinuous diameter. Accordingly, the current distribution in the antenna does not have a sinusoidal profile, as shown in FIGS. 18 and 19. With such a non-sinusoidal current distribution in the antenna, target impedance characteristics cannot be obtained even if the respective lengths of non-retracted antenna 151 and extension antenna 102 are designed so that they resonate in response to the radio waves of a target frequency.

Moreover, as shown in FIGS. 18 and 19, the presence of metal boss 150 increases a current value in the region near main body 108 of mobile phone 101. This results in increased electric-field and magnetic-field strengths (electromagnetic-field strength) in the region near main body 108. The user holds main body 108 of mobile phone 101 by hand and also holds main body 108 near the head for a phone call. In this case, since metal boss 150 of main body 108 located in a region relatively close to the human body produces a relatively strong electromagnetic field, the presence of the human body affects the antenna gain more strongly. The antenna gain is thus reduced by the influence of the human body, resulting in degraded communication quality.

Moreover, metal boss 150 is formed from a metal having relatively larger specific gravity than a material of the housing of mobile phone 101 and the like such as plastic. Reduction in size and weight has been strongly demanded for mobile phone 101, and the use of a metal boss is one of the factors that hinder reduction in weight of the mobile phone.

The present invention is made to solve the above problems, and it is an object of the present invention to provide an antenna device and a portable equipment that are capable of preventing degradation in communication quality.

It is another object of the present invention to provide an antenna device and a portable equipment that enable reduction in weight.

DISCLOSURE OF THE INVENTION

An antenna device according to one aspect of the present invention includes a linear antenna, a fixing member and a power feed member. The fixing member is formed from a dielectric, and holds a portion of the antenna. The power feed member contacts the antenna. The fixing member holds the antenna in a movable manner.

In this structure, the fixing member such as a boss for holding a portion of the antenna is formed from a dielectric, whereby the antenna and the fixing member can be prevented from acting as if they were an antenna having an electrically discontinuous diameter. As a result, a current flowing through the antenna can be prevented from unnecessarily flowing through the fixing member. This enables the current distribution in the antenna to have an approximately sinusoidal profile, whereby the impedance characteristics of the antenna can be prevented from being varied from the designed characteristics.

When the antenna device of the present invention is applied to a portable equipment such as a mobile phone, the fixing member is mounted to the main body of the portable equipment. In using such a portable equipment, the main body thereof is often held by hand and retained near the head of the human body. In other words, the fixing member is located in a region relatively close to the human body. In the antenna device of the present invention, the fixing member is formed from a dielectric, so that no current will unnecessarily flow through the fixing member. Accordingly, an electromagnetic field that is conventionally formed by the current flowing through the fixing member will not be formed. Since a current flowing through the antenna thus produces a weaker electromagnetic field in the region relatively close to the human body as compared to the conventional example, characteristics such as antenna gain can be less affected by the presence of the human body. As a result, the characteristics such as antenna gain can be prevented from being degraded by the influence of the human body.

Moreover, since the fixing member is formed from a dielectric, a material such as a resin having relatively smaller specific gravity than a metal used in the conventional example can be used as a material of the fixing member. As a result, by applying the antenna device of the present invention to a portable radio equipment such as a mobile phone, the weight of the portable radio equipment can be reduced as compared to the case of using a metal fixing member.

In the antenna device according to the aforementioned one aspect, the fixing member may have an opening for exposing a part of a surface of the portion of the antenna that is held by the fixing member, and the power feed member may contact the part of the surface of the antenna through the opening.

In this case, electrical connection between the power feed member and the antenna can be implemented with the fixing member having a relatively simple structure, i.e., the fixing member having an opening. As a result, the structure of the antenna device can be simplified. Moreover, complicated processing is not required such as embedding the power feed member into the wall of the fixing member, enabling reduction in manufacturing costs of the antenna device.

In the antenna device according to the aforementioned one aspect, the antenna may include an extended portion extending out of the fixing member, and the power feed member may be mounted in contact with the extended portion.

In this case, since the contact between the antenna and the power feed member is ensured in a region other than the region where the fixing member is located, connection between the antenna and the power feed member can be assured without requiring special processing such as providing the fixing member with a conductive wire that contacts the antenna. This enables a further simplified structure of the antenna device and reduction in manufacturing costs thereof.

In the antenna device of the aforementioned one aspect, the fixing member is preferably a cylindrical member having a hole, and the antenna is preferably inserted in the hole of the cylindrical fixing member.

In this case, when a region of the antenna that is fixed to the fixing member has an outer diameter that is approximately the same as the hole diameter of the fixing member, the position of the antenna relative to the fixing member can be easily determined by making that region in contact with the sidewall of the hole in the fixing member.

In the antenna device according to the aforementioned one aspect, the power feed member may contact the antenna within the hole of the fixing member.

In this case, since the power feed member and the antenna contact each other within the fixing member, the volume of the region occupied by the antenna device can be reduced as compared to the case where the power feed member and the antenna contact each other outside the fixing member. As a result, reduction in size of the antenna device can be achieved.

In the antenna device according to the aforementioned one aspect, the fixing member is preferably formed from a resin.

In this case, the fixing member can be easily formed due to better processability of the resin than that of a metal or the like.

A portable equipment according to another aspect of the present invention includes a housing, a linear antenna, a fixing member and a power feed member. The fixing member is formed from a dielectric, and holds a portion of the antenna so as to fix the antenna to the housing. The fixing member holds the antenna in a movable manner. The power feed member contacts the antenna.

In this structure, the fixing member such as a boss for holding a portion of the antenna is formed from a dielectric, whereby the antenna and the fixing member can be prevented from acting as if they were an antenna having an electrically discontinuous diameter. As a result, a current flowing through the antenna can be prevented from unnecessarily flowing through the fixing member. This enables the current distribution in the antenna to have an approximately sinusoidal profile, whereby the impedance characteristics of the antenna can be prevented from being varied from the designed characteristics. As a result, degradation in communication quality can be prevented in the portable equipment such as a mobile phone and a radio device.

Since the antenna is mounted to the portable equipment, the fixing member is mounted to the main body of the portable equipment. In using such a portable equipment, the main body thereof is often held by hand and retained near the head of the human body. In other words, the fixing member is located in a region relatively close to the human body. In the portable equipment of the present invention, the fixing member is formed from a dielectric, so that no current will unnecessarily flow through the fixing member. Accordingly, an electromagnetic field that is conventionally formed by the current flowing through the fixing member will not be formed. Since a current flowing through the antenna thus produces a weaker electromagnetic field in the region relatively close to the human body as compared to the conventional example, characteristics such as antenna gain can be less affected by the presence of the human body. As a result, the characteristics such as antenna gain can be prevented from being degraded by the influence of the human body.

Moreover, since the fixing member is formed from a dielectric, a material such as a resin having relatively smaller specific gravity than a metal used in the conventional example can be used as a material of the fixing member. As a result, the weight of the portable equipment can be reduced as compared to the case of using a metal fixing member.

In the portable equipment according to the aforementioned another aspect, the fixing member may have an opening for exposing a part of a surface of the portion of the antenna that is held by the fixing member, and the power feed member may contact the part of the surface of the antenna through the opening.

In this case, electrical connection between the power feed member and the antenna can be implemented with the fixing member having a relatively simple structure, i.e., the fixing member having an opening. As a result, the structure of the portable equipment can be simplified. Moreover, complicated processing is not required such as embedding the power feed member into the wall of the fixing member, enabling reduction in manufacturing costs of the portable equipment.

In the portable equipment according to the aforementioned another aspect, the antenna may include an extended portion extending out of the fixing member within the housing, and the power feed member may be mounted in contact with the extended portion.

In this case, since the contact between the antenna and the power feed member is ensured in a region other than the region where the fixing member is located, connection between the antenna and the power feed member can be assured without requiring special processing for the fixing member such as providing the fixing member with a conductive wire that contacts the antenna. This enables a further simplified structure of the portable equipment and reduction in manufacturing costs thereof.

In the portable equipment according to the aforementioned another aspect, the fixing member is preferably a cylindrical member having a hole, and the antenna is preferably inserted in the hole of the cylindrical fixing member.

In this case, when a region of the antenna that is fixed to the fixing member has an outer diameter that is approximately the same as the hole diameter of the fixing member, the position of the antenna relative to the fixing member can be easily determined by making that region in contact with the sidewall of the hole in the fixing member.

In the portable equipment according to the aforementioned another aspect, the power feed member may contact the antenna within the hole of the fixing member.

In this case, since the power feed member and the antenna contact each other within the fixing member, the volume of the region required for the connection between the power feed member and the antenna can be reduced as compared to the case where the power feed member and the antenna contact each other outside the fixing member. As a result, reduction in size of the portable equipment can be achieved.

The portable equipment according to the aforementioned another aspect may further include a substrate held within the housing. The power feed member may include a conductor member contacting the portion of the antenna that is held by the fixing member, and being connected to the fixing member, and an electrode contacting the conductor member and mounted on the substrate.

In this case, the antenna can be electrically connected to circuit elements on the substrate through the conductor member and the electrode. Since the electrode need only have a contact surface that contacts the conductor member, a simply structured conductor member on the substrate such as a conductor film or electrode plate mounted on the substrate can be used as the electrode. As a result, the structure of the substrate can be simplified as compared to the case where a structure such as a power feed pin is mounted on the substrate.

In the portable equipment according to the aforementioned another aspect, the fixing member is preferably formed from a resin.

In this case, the fixing member can be easily formed due to better processability of the resin than that of a metal or the like.

BEST MODE FOR CARRYING OUT THE INVENTION

Figure 1:
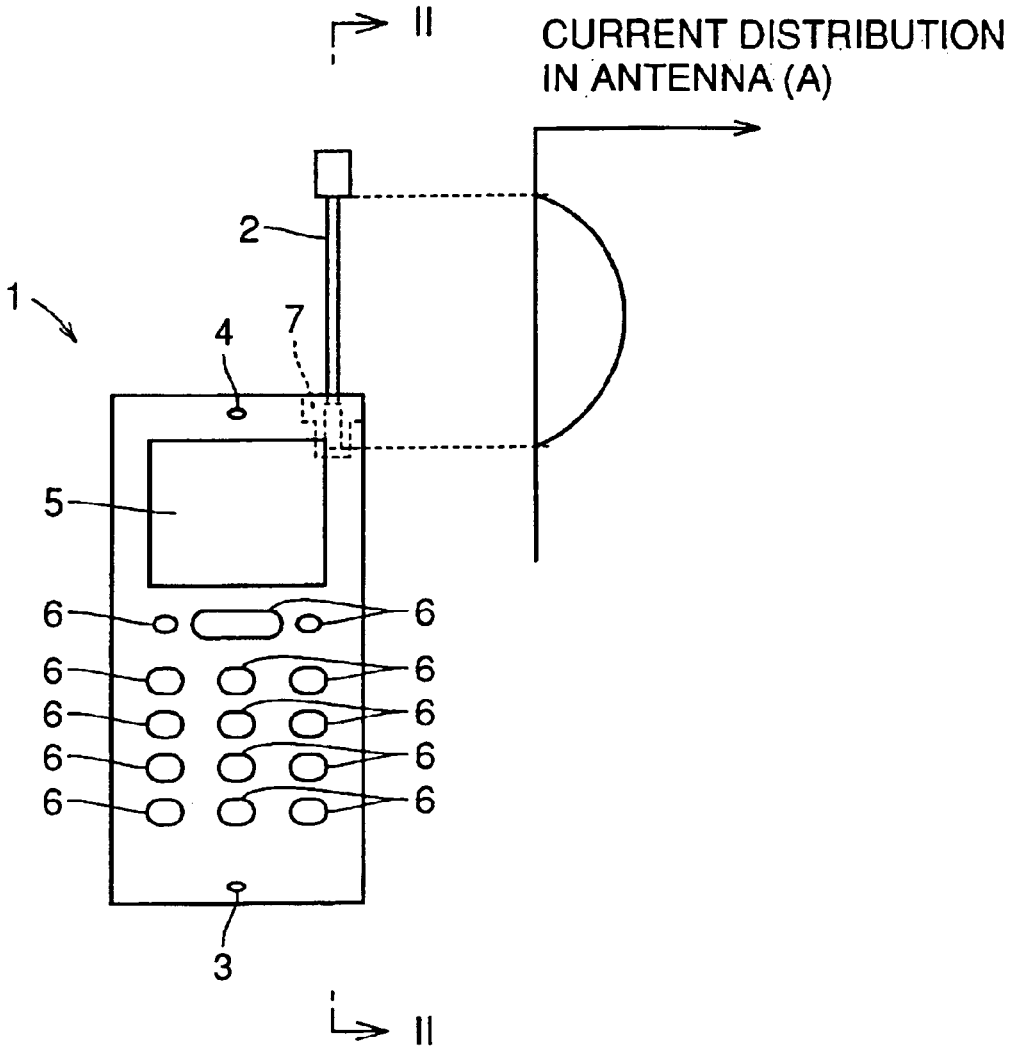
FIG. 1 shows a schematic diagram of a first embodiment of a mobile phone according to the present invention and a schematic graph of a current distribution in an antenna.

Hereinafter, embodiments of the present invention will be described with reference to the accompanying drawings. Note that, in the following figures, the same or corresponding portions are denoted with the same reference numerals, and description thereof will not be repeated.

First Embodiment

The first embodiment of a mobile phone as a portable equipment of the present invention will now be described with reference to FIGS. 1 and 2.

Figure 2:
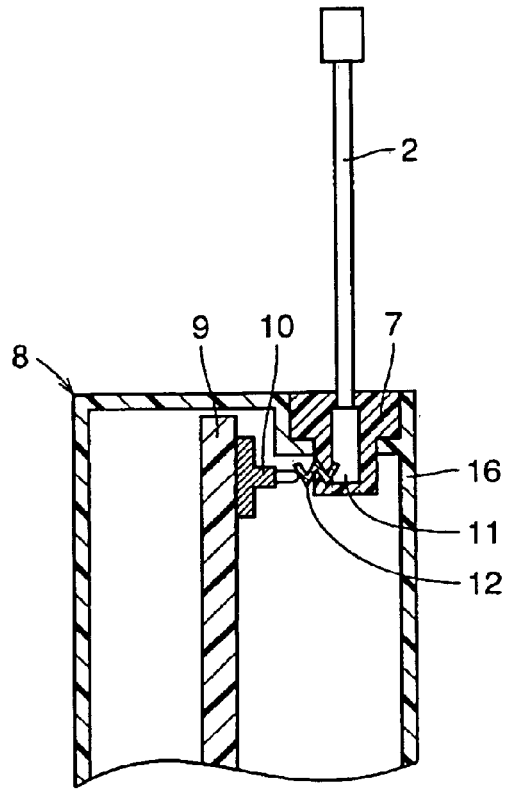
FIG. 2 is a schematic partial cross-sectional view taken along line II—II in FIG. 1.

Referring to FIGS. 1 and 2, a mobile phone 1 includes a main body 8 and a linear antenna 2 mounted to main body 8. Elements such as a liquid crystal display portion 5, a speaker 4, a microphone 3 and operation keys 6 for inputting a telephone number and the like are arranged at the surface of main body 8. A resin case 16 forming a housing of main body 8 holds therein a circuit substrate 9 as a substrate having control portions such as a transmitting/receiving circuit arranged thereon. In order to fix antenna 2 to main body 8, a boss 7 formed from a resin, i.e., a dielectric, is mounted to case 16 as a fixing member. Boss 7 is a cylindrical boss having a hole at the center for receiving antenna 2. Desirably, ABS resin (acrylonitrile-butadien-styrene copolymer) is used for boss 7. In this case, boss 7 can be easily formed due to better processability of the resin than that of a metal or the like. The hole in boss 7 is a through hole extending from the outer periphery of main body 8 to the inner periphery thereof. Antenna 2 is slidable along the hole of boss 7 and thus retractable in main body 8. Note that FIGS. 1 and 2 show the state where antenna 2 is stretched out of main body 8. When antenna 2 is stretched out of main body 8, the outer peripheral surface of an antenna end 11 connected to the lower portion of antenna 2 fixedly contacts the inner wall of boss 7, whereby antenna 2 is prevented from slipping out of main body 2. In this way, when antenna end 11, i.e., a region of the antenna for fixing the antenna to boss 7, has an outer diameter that is approximately the same as the hole diameter of boss 7, the position of antenna 2 relative to boss 7 can be easily determined by making the surface of antenna end 11 in contact with the sidewall of the hole in boss 7.

A metal spring 12 of a power feed member extends through the sidewall of boss 7 from the inner peripheral surface of the hole in boss 7 to the outer peripheral surface of boss 7, and contacts antenna end 11 of antenna 2. One end of metal spring 12 thus contacts antenna end 11. The other end of metal spring 12 sticks out of the outer peripheral surface of boss 7 and contacts a power feed pin 10 of the power feed member, which is mounted on the surface of circuit substrate 9. Antenna 2, antenna end 11, boss 7, metal spring 12, power feed pin 10 and circuit substrate 9 form an antenna device.

In this structure, boss 7 for holding part of the antenna, i.e., antenna end 11, is formed from a resin as a dielectric, whereby antenna 2 and boss 7 can be prevented from acting as if they were an antenna having an electrically discontinuous diameter. As a result, a current flowing through antenna 2 can be prevented from unnecessarily flowing through boss 7. This enables the current distribution in antenna 2 to have an approximately sinusoidal profile as shown in FIG. 1, whereby the impedance characteristics of the antenna can be prevented from being varied from the designed characteristics. As a result, degradation in communication quality of mobile phone 1 can be prevented.

In using such a mobile phone 1, main body 8 is often held by hand and retained near the head of the human body. In other words, boss 7 is located in a region relatively close to the human body. In mobile phone 1 of FIGS. 1 and 2, boss 7 is formed from a dielectric such as a resin, so that no current will unnecessarily flow through boss 7. Accordingly, an electromagnetic field that is conventionally formed by the current flowing through boss 7 will not be formed. Since a current flowing through antenna 2 thus produces a weaker electromagnetic field in the region relatively close to the human body as compared to the conventional example, characteristics such as gain of antenna 2 can be less affected by the presence of the human body. As a result, the characteristics such as gain of antenna 2 can be prevented from being degraded by the influence of the human body.

Moreover, since boss 7 is formed from a resin having relatively smaller specific gravity than a metal used in the conventional example, the weight of mobile phone 1 can be reduced as compared to the mobile phone using metal boss 7.

Moreover, since one end of metal spring 12 and antenna end 11 contact each other within boss 7, the volume of a region required for the connection between antenna 2 and the power feed member can be reduced as compared to the case where antenna end 11 and the power feed member formed from metal spring 12 and power feed pin 10 contact each other outside boss 7. As a result, reduction in size of mobile phone 1 can be achieved.

Figure 3:
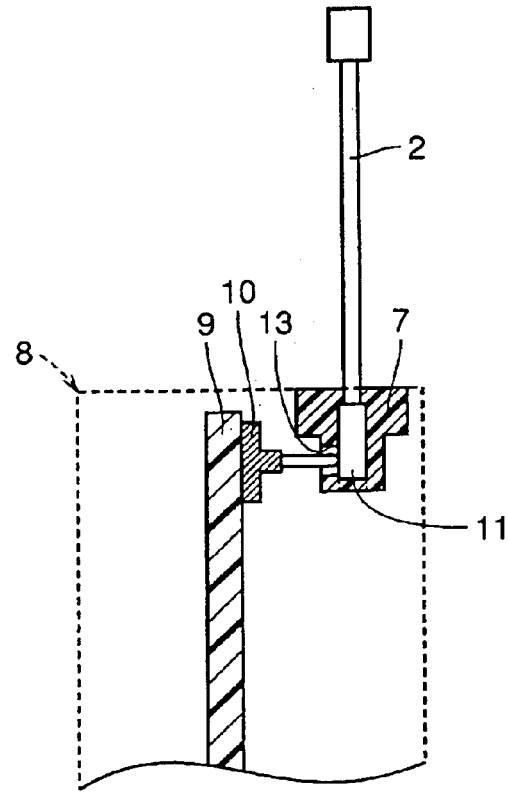
FIG. 3 is a schematic cross-sectional view of a modification of the first embodiment of the mobile phone according to the present invention shown in FIGS. 1 and 2.

Referring to FIG. 3, a modification of the first embodiment of the mobile phone according to the present invention basically has the same structure as that of the mobile phone shown in FIGS. 1 and 2. Note that FIG. 3 corresponds to FIG. 2. The mobile phone of FIG. 3 has a boss opening 13 formed as a through hole in the sidewall of resin boss 7. Boss opening 13 exposes a part of the surface of antenna end 11 located in the lower portion of antenna 2. The tip of power feed pin 10 directly contacts the surface of antenna end 11 through boss opening 13. As a result, power feed pin 10 and antenna 2 are directly electrically connected to each other through antenna end 11.

In this case, the same effects as those of the mobile phone of FIGS. 1 and 2 can be obtained. Moreover, electrical connection between power feed pin 10 serving as a power feed member and antenna 2 can be implemented with boss 7 having a relatively simple structure, i.e., boss 7 having an opening. As a result, the structure of mobile phone 1 can be simplified. Moreover, complicated processing is not required such as embedding metal spring 12 serving as a power feed member into the wall of boss 7, enabling reduction in manufacturing costs of mobile phone 1.

Second Embodiment

The second embodiment of the mobile phone according to the present invention will now be described with reference to FIG. 4. Note that FIG. 4 corresponds to FIG. 2.

Figure 4:
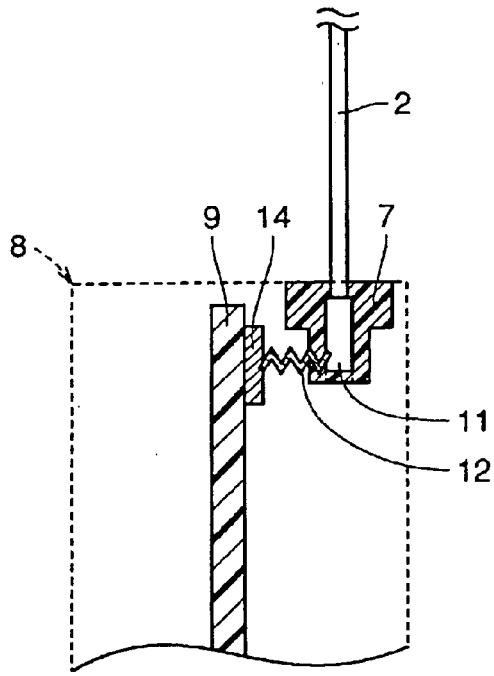
FIG. 4 is a schematic partial cross-sectional view of a second embodiment of the mobile phone according to the present invention.

Referring to FIG. 4, the mobile phone basically has the same structure as that of the mobile phone shown in FIGS. 1 and 2. In the mobile phone of FIG. 4, however, power feed pin 10 on the surface of substrate 9 is replaced with a power feed pad 14 as an electrode formed from a simple conductor film or the like. Metal spring 12 as a power feed member extends through the sidewall of boss 7 so that one end of metal spring 12 contacts antenna end 11 and the other end thereof directly contacts power feed pad 14.

In this case, the same effects as those of the mobile phone according to the first embodiment of the present invention can be obtained. Moreover, antenna 2 can be electrically connected to the circuit elements on circuit substrate 9 through metal spring 12 as a conductor member and simply structured power feed pad 14 as an electrode having a conductor film formed on the surface. As a result, the structure of circuit substrate 9 can be simplified as compared to the case where a structure such as power feed pin 10 is mounted on circuit substrate 9.

Third Embodiment

The third embodiment of the mobile phone according to the present invention will now be described with reference to FIG. 5. Note that FIG. 5 corresponds to FIG. 3.

Figure 5:
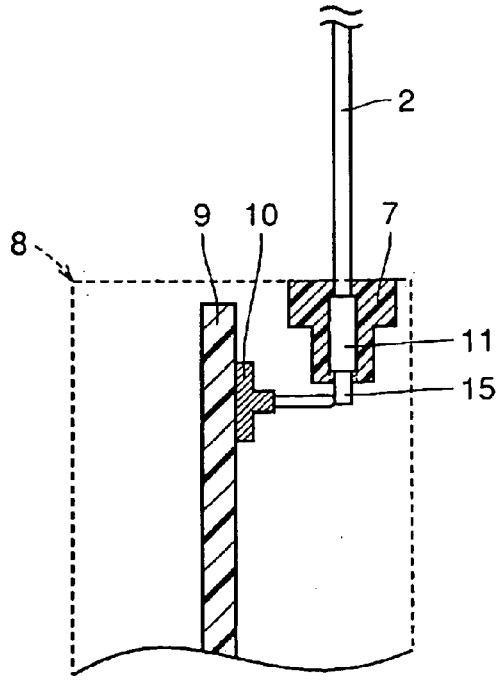
FIG. 5 is a schematic partial cross-sectional view of a third embodiment of the mobile phone according to the present invention.

Referring to FIG. 5, the mobile phone basically has the same structure as that of the first embodiment of the mobile phone according to the present invention. However, the mobile phone of FIG. 5 does not include a metal spring extending through the sidewall of resin boss 7. Under antenna end 11, an antenna-end power feed portion 15 extends to the outside of boss 7 as an extended portion of antenna 2. Power feed pin is mounted on the surface of substrate 9 so as to contact antenna-end power feed portion 15. Power feed pin 10 on substrate 9 is thus electrically connected to antenna 2 through antenna-end power feed portion 15.

In this case as well, the same effects as those of the first embodiment of the mobile phone of the present invention can be obtained. Moreover, since the contact portion between antenna 2 and power feed pin 10 as a power feed member is located outside boss 7, connection between antenna 2 and power feed pin 10 can be assured without requiring special processing for boss 7 such as providing boss 7 with metal spring 12 that contacts antenna end 11. This enables a further simplified structure of mobile phone 1 and reduction in manufacturing costs thereof.

Fourth Embodiment

Figure 6:
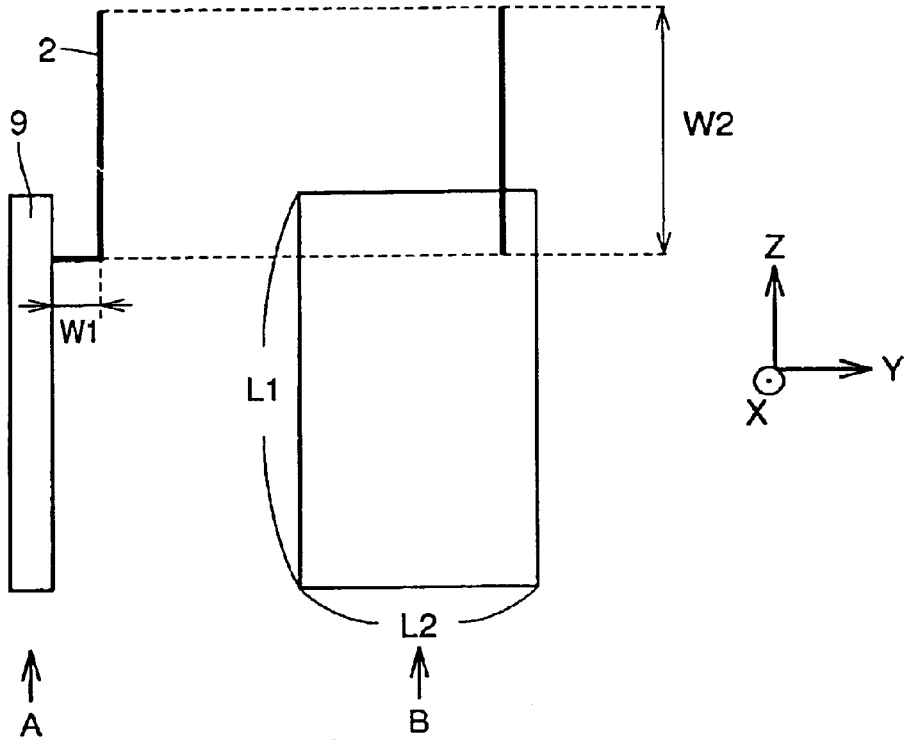
FIG. 6 shows a schematic side view A and a schematic front view B of an antenna device simulating the mobile phone of the present invention and used to measure a radiation pattern in order to verify the effects of the first to third embodiments of the mobile phone according to the present invention.

Referring to FIG. 6, an antenna device is formed from substrate 9 and linear antenna 2 mounted thereto. Substrate 9 has a length L1 of 116 mm and a width L2 of 36 mm. Antenna 2 has a height W1 of 6 mm and a length W2 of 66 mm. Note that the extension direction of antenna 2 is defined as +Z direction in the figure. In the schematic front view B of the antenna device, the direction from left to right in FIG. 6 is defined as +Y direction. The direction from the back of the plane of the figure toward the front thereof is defined as +X direction.

Figure 7:
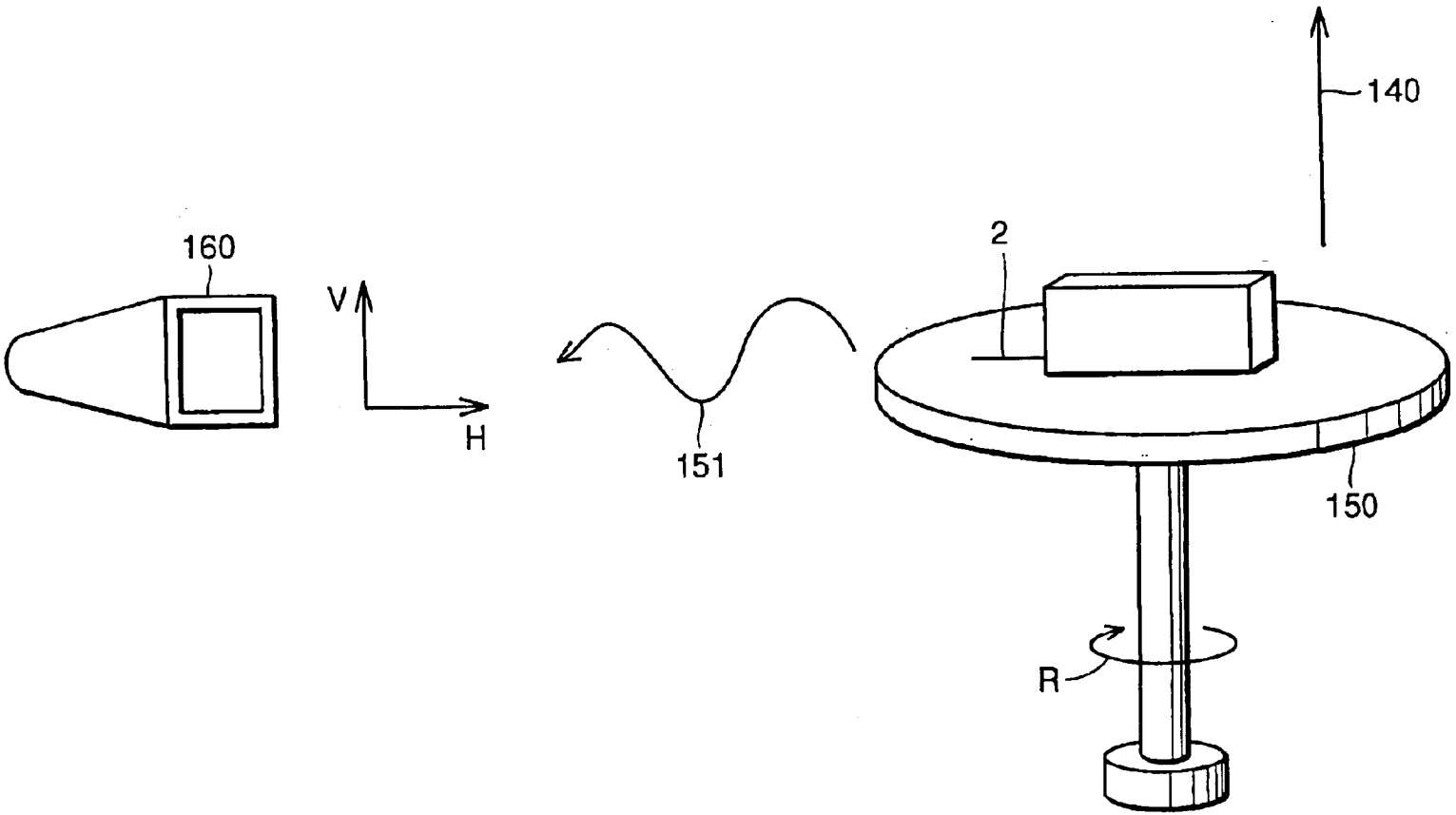
FIG. 7 illustrates the step of measuring a radiation pattern on X-Z plane in FIG. 6.

Referring to FIG. 7, the antenna device of FIG. 6 was first placed on a table 150. The antenna device was placed such that the extension direction of antenna 2, i.e., +Z direction, and +X direction were approximately perpendicular to the vertical direction shown by arrow 140. Accordingly, +Y direction was approximately parallel to the vertical direction shown by arrow 140. Table 150 is rotatable in the direction shown by arrow R.

With the antenna device being placed on such a table 150, radio waves having a frequency of 1.95 GHz were radiated from the antenna device through antenna 2 at a prescribed output. During radiation, table 150 was rotated in the direction shown by arrow R. As a result, radio waves were radiated from antenna 2 as shown by arrow 151. The electric field strength of the radio waves was measured with a measuring antenna 160. The electric field strength of the radio waves was thus obtained for vertically polarized waves in the direction shown by arrow V and horizontally polarized waves in the direction shown by arrow H.

Figure 8:
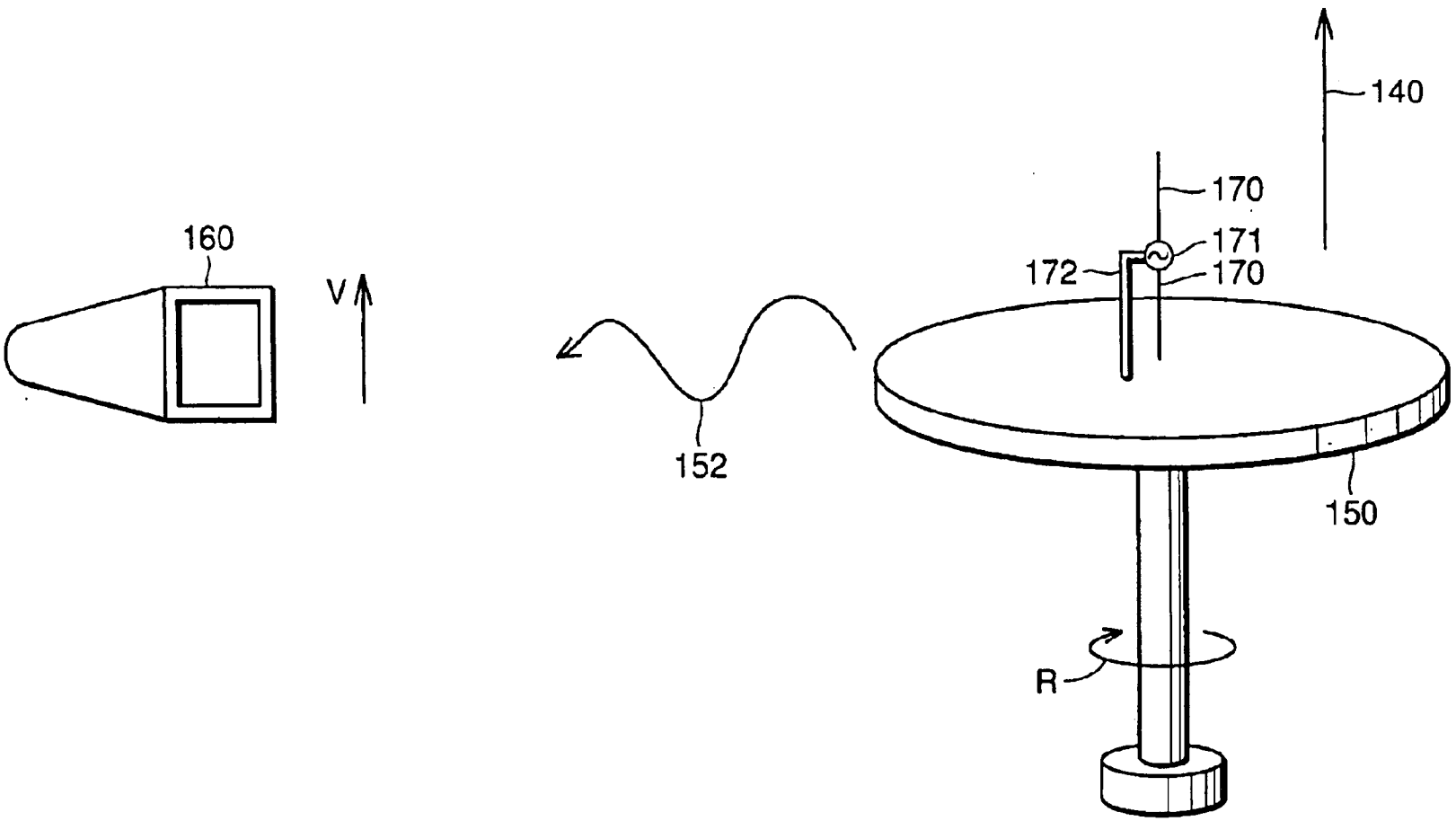
FIG. 8 illustrates the step of measuring a radiation pattern on X-Z plane in FIG. 6.

Referring to FIG. 8, a dipole antenna 170 was placed on table 150. Dipole antenna 170 has a power feed point 171 in the center, which is connected to a coaxial cable 172. Coaxial cable 172 is connected to a prescribed radio transmitting/receiving portion. Dipole antenna 170 was placed so as to extend approximately in parallel with the vertical direction shown by arrow 140. When the same output as that applied to antenna 2 of FIG. 7 was applied to dipole antenna 170 while rotating table 150 in the direction shown by arrow R, radio waves having a frequency of 1.95 GHz were radiated from dipole antenna 170. The radio waves were thus radiated from dipole antenna 170 as shown by arrow 152. These radio waves are vertically polarized waves of the direction shown by arrow V. The electric field strength of the radio waves was measured with measuring antenna 160.

Figure 9:
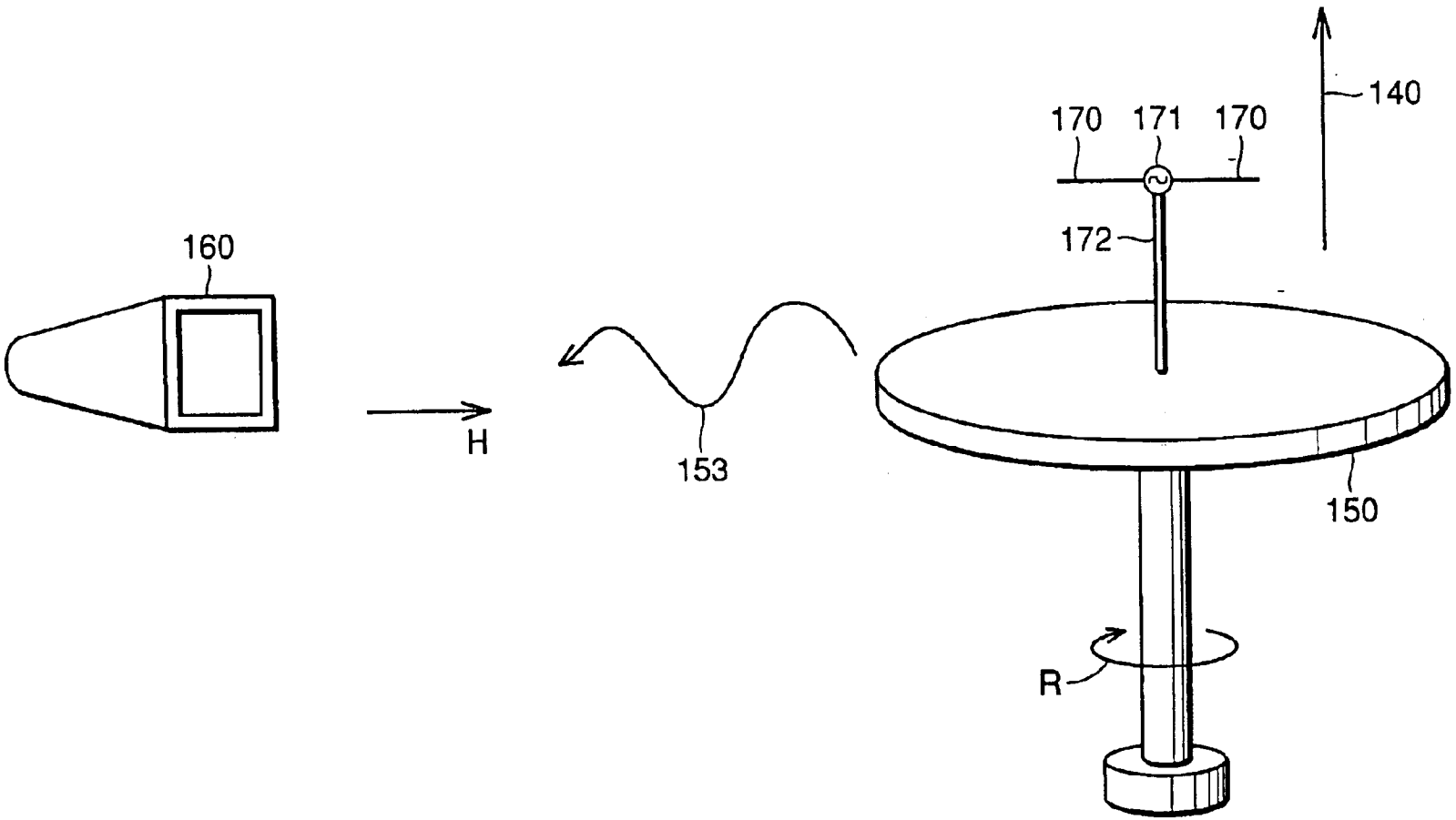
FIG. 9 illustrates the step of measuring a radiation pattern on X-Z plane in FIG. 6.

Referring to FIG. 9, dipole antenna 170 was placed on table 150. Dipole antenna 170 was placed so as to extend approximately perpendicularly to the vertical direction shown by arrow 140. Dipole antenna 170 has power feed point 171 in the center. Power feed point 171 is connected to coaxial cable 172. When the same output as that applied to antenna 2 of FIG. 7 was applied to dipole antenna 170 while rotating table 150 in the direction shown by arrow R, radio waves having a frequency of 1.95 GHz were radiated from dipole antenna 170 as shown by arrow 153. These radio waves are horizontally polarized waves of the direction shown by arrow H. The electric field strength of the radio waves was measured with measuring antenna 160.

Figure 10:
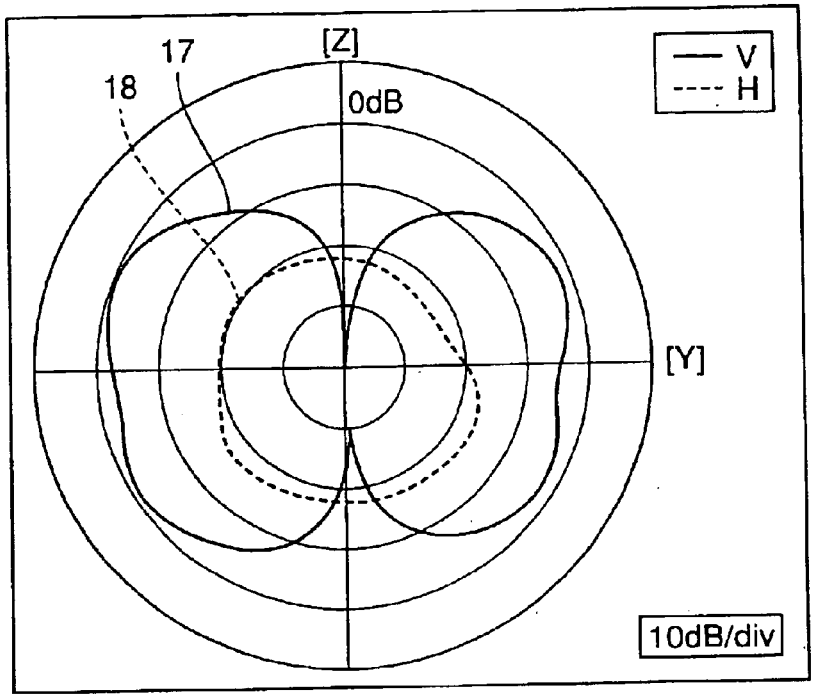
FIG. 10 is a graph of a radiation pattern on X-Z plane of the antenna device according to the present invention.
Figure 11:
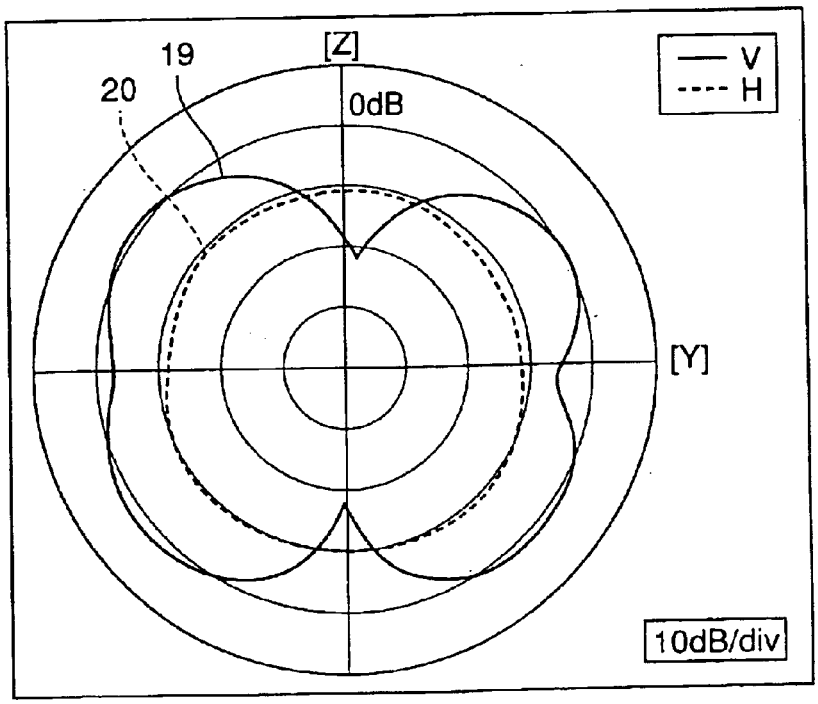
FIG. 11 is a graph of a radiation pattern on X-Z plane of a conventional mobile phone.
Figure 12:
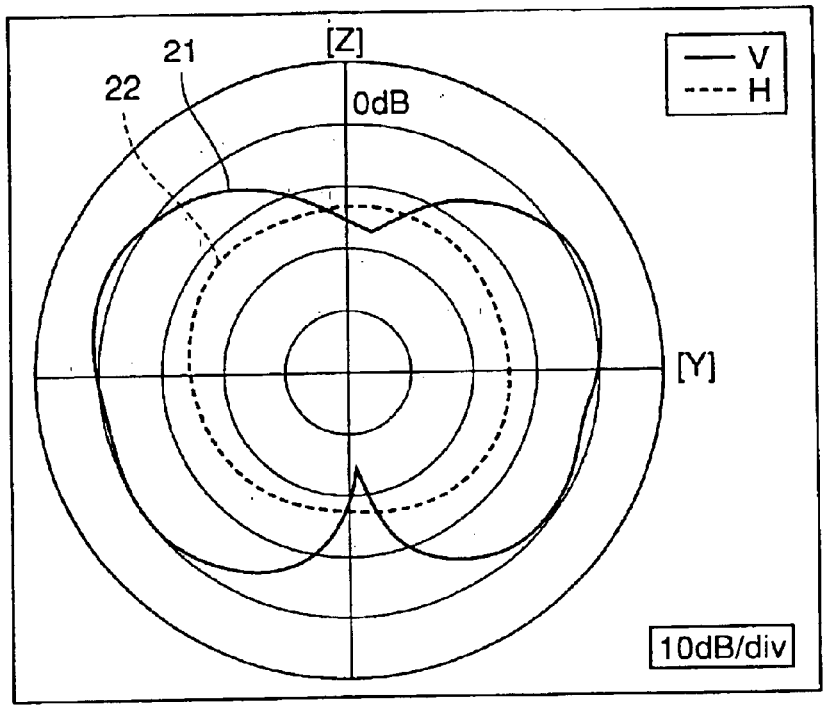
FIG. 12 is a graph of a radiation pattern on X-Z plane of the conventional mobile phone.
Figure 13:
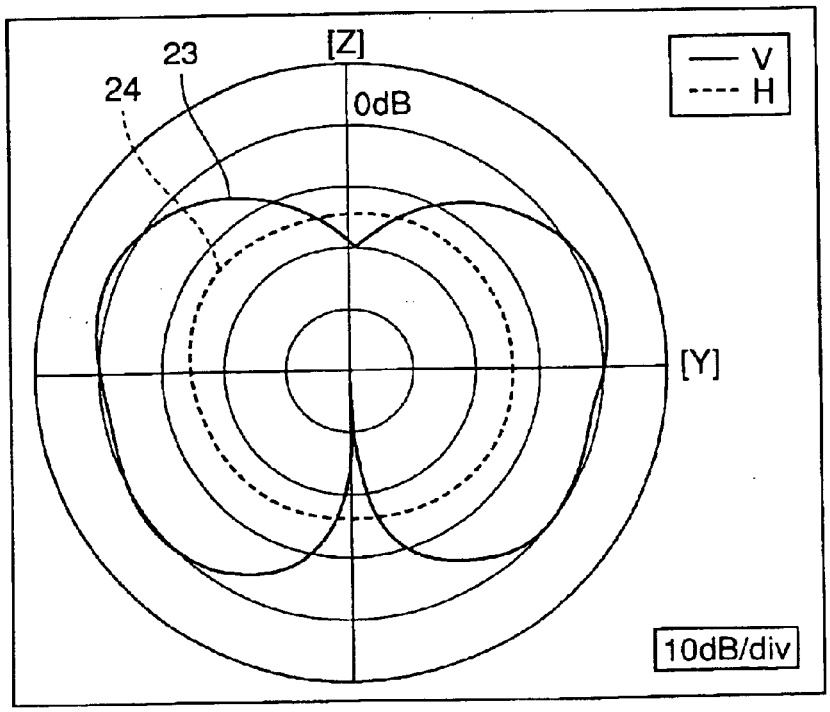
FIG. 13 is a graph of a radiation pattern on X-Z plane of the conventional mobile phone.
Figure 14:
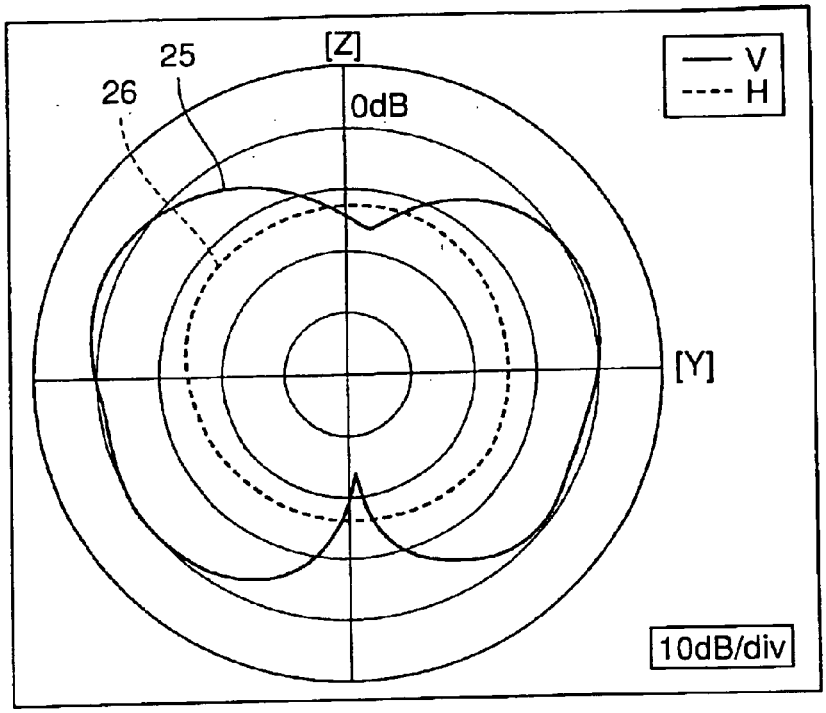
FIG. 14 is a graph of a radiation pattern on X-Z plane of the conventional mobile phone.
Figure 15:
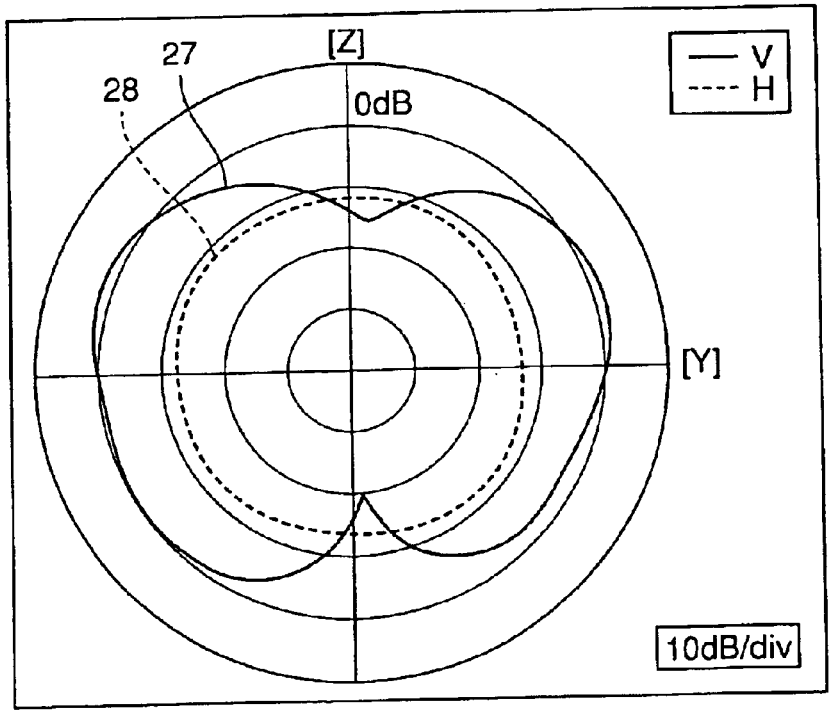
FIG. 15 is a graph of a radiation pattern on X-Z plane of the conventional mobile phone.
Figure 16:
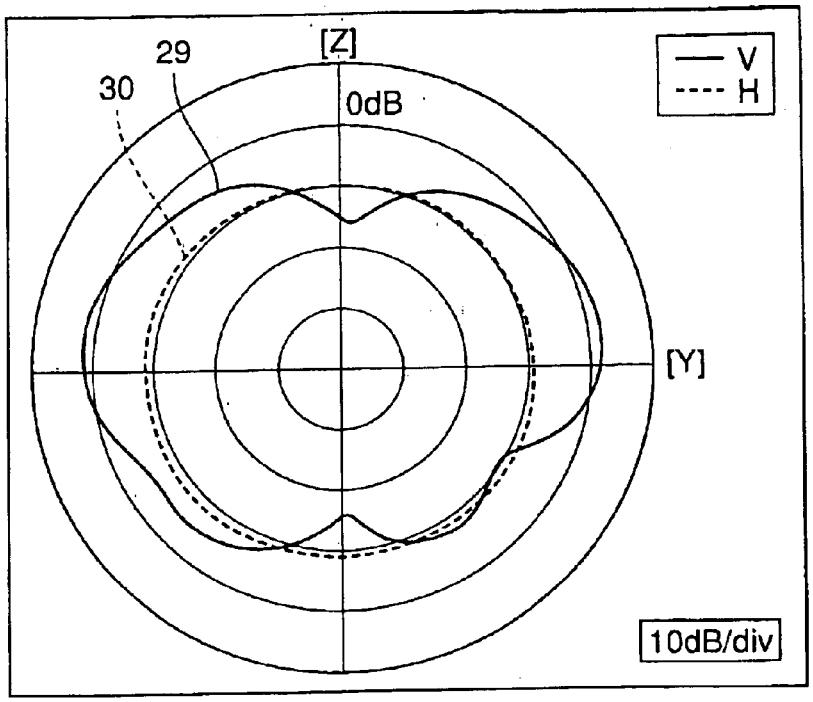
FIG. 16 is a graph of a radiation pattern on X-Z plane of the conventional mobile phone.

A radiation pattern of an antenna device simulating the mobile phone of the present invention was obtained based on the data obtained by the steps of FIGS. 7 to 9. The result is shown in FIG. 10. FIG. 10 is a graph showing the radiation pattern of the antenna device of FIG. 6. Referring to FIG. 10, solid line 17 indicates the gain of the vertically polarized wave components of the radio waves radiated from antenna 2 of FIG. 7 for the electric field strength of the vertically polarized waves radiated from dipole antenna 170 in the step of FIG. 8. This gain was calculated according to the following equation:

(Gain)=$20\times\log_{10}$ (the electric field strength of the vertically polarized waves from antenna 2/the electric field strength of the vertically polarized waves from dipole antenna 170).

Dotted line 18 indicates the gain of the horizontally polarized wave components of the radio waves radiated from antenna 2 of FIG. 7 for the electric field strength of the horizontally polarized waves radiated from dipole antenna 170 in the step of FIG. 9. This gain was calculated according to the following equation:

(Gain)=$20\times\log_{10}$ (the electric field strength of the horizontally polarized waves from antenna 2/the electric field strength of the horizontally polarized waves from dipole antenna 170).

The antenna device of FIG. 6 is a half-wave antenna having a length (W1+W2) of 72 mm which is approximately equal to a theoretical antenna length. This antenna device has an excellent radiation pattern as shown in FIG. 10. Note that, in FIG. 10 and FIGS. 11 to 16 described below, a division corresponds to 10 dB. A point on X-axis, i.e., the abscissa of FIG. 10, is a point indicating the gain in the state where X-axis in FIG. 6 extends toward measuring antenna 160, and a point on Z-axis, i.e., the ordinate, is a point indicating the gain in the state where Z-axis in FIG. 6 extends toward measuring antenna 160.

Figure 17:
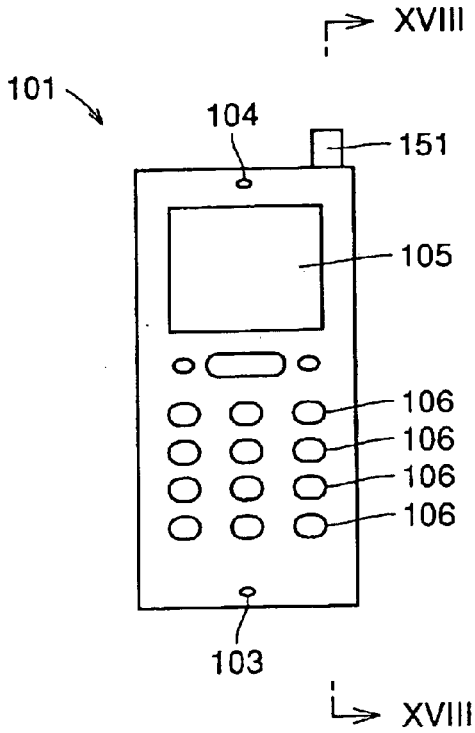
FIG. 17 PRIOR ART
FIG. 17 is a schematic diagram of the conventional mobile phone.
Figure 18:
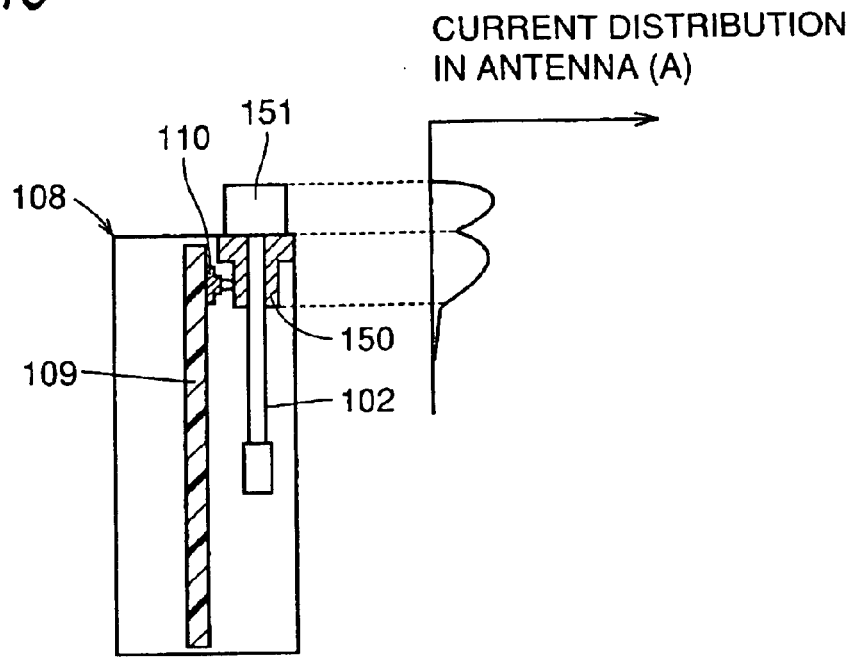
FIG.18 PRIOR ART
FIG. 18 shows a schematic cross-sectional view taken along line XVIII—XVIII in FIG. 17 and a schematic graph of a current distribution in an antenna.
Figure 19:
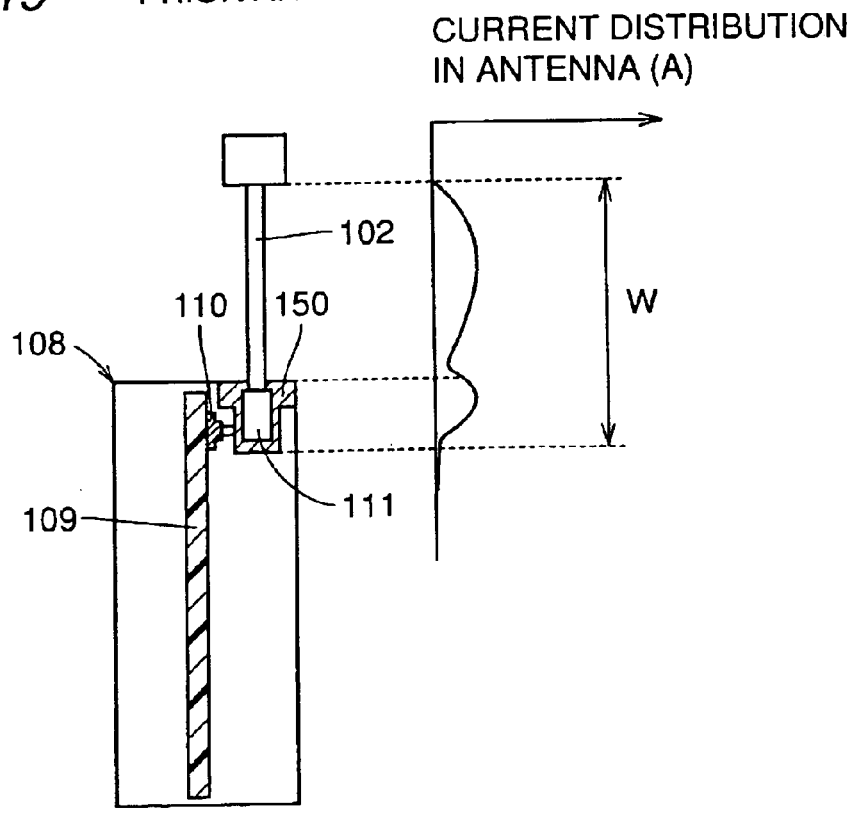
FIG.19 PRIOR ART
FIG. 19 shows a schematic cross-sectional view of the state where the antenna is stretched out of the main body of the mobile phone in FIG. 17 and a schematic graph of a current distribution in the antenna.

For comparison, radiation patterns of the conventional mobile phone of FIGS. 17 to 19 were obtained for various lengths of antenna 120, based on the data measured by the same steps as those of FIGS. 7 to 9. The result is shown in FIGS. 11 to 16. FIGS. 11 to 16 show the radiation patterns of the conventional mobile phone whose linear antenna 102 has a length of 45 mm, 48 mm, 55 mm, 60 mm, 62.5 mm and 65 mm, respectively. Referring to FIGS. 11 to 16, solid lines 19, 21, 23, 25, 27, 29 show the gain of the vertically polarized wave components of the radio waves radiated from antenna 102 for the electric field strength of the vertically polarized waves radiated from dipole antenna 170 in the step of FIG. 8, wherein the conventional mobile phone of FIG. 19 was placed in the same manner as that of the antenna device of FIG. 7. The gain was calculated by the same equation as that used for solid line 17 in FIG. 10. Dotted lines 20, 22, 24, 26, 28, 30 in FIGS. 11 to 16 show the gain of the horizontally polarized waves of the radio waves radiated from antenna 102 for the electric field strength of the horizontally polarized waves radiated from dipole antenna 170 in the step of FIG. 9, wherein the conventional mobile phone of FIG. 19 was used instead of the antenna device of FIG. 7. The gain was calculated by the same equation as that used for dotted line 18 in FIG. 10.

Referring to FIGS. 11 to 16, the conventional mobile phone has a relatively good radiation pattern when antenna 102 has a length of 55 to 60 mm. However, this length of antenna 102 is different from a theoretically required value. This seems to result from the fact that a relatively large current flowing through metal boss 150 varies the current distribution in antenna 102. Conventionally, the presence of metal boss 150 necessitates measurement of the radiation patterns for various antenna lengths as shown in FIGS. 11 to 16 in order to obtain an optimal radiation pattern. However, since the present invention uses resin boss 7, linear antenna 2 can be regarded as a linear antenna having an approximately uniform diameter. Therefore, an excellent radiation pattern can be obtained by using antenna 2 having a length relatively close to a theoretical value.

Although embodiments of the present invention have been described above, characteristics of each embodiment may be combined as necessary. The embodiments as disclosed herein are by way of illustration and example only in every respect, and are not to be taken by way of limitation. The scope of the present invention is not defined by the foregoing embodiments, but rather defined by the appended claims, and includes all modifications that fall within the equivalent and scope of the appended claims.

Industrial Applicability

The antenna device and the portable equipment according to the present invention can be utilized not only in the mobile phones but also in the field of portable information terminals such as a personal computer having a communication function.

What is claimed is:

1. An antenna device, comprising:

a linear antenna including a conducting portion having predetermined impedance characteristics and designed to enable a current distribution of the antenna to have an approximately sinusoidal profile;

a fixing member formed from a dielectric and configured to hold the conducting portion of said antenna; and a power feed member contacting said antenna, wherein said fixing member directly contacts and holds said conducting portion of said antenna in a movable manner and said fixing member has an opening for exposing a part of a surface of the conducting portion of said antenna that is held by said fixing member, and said power feed member contacts the part of the surface of said antenna through said opening.

2. An antenna device, comprising:

a linear antenna including a conducting portion having predetermined impedance characteristics and designed to enable a current distribution of the antenna to have an approximately sinusoidal profile;

a fixing member formed from a dielectric and configured to hold the conducting portion of said antenna;

a power feed member contacting said antenna; and a substrate situated opposite to said fixing member, said power feed member provided on said substrate; wherein said fixing member directly contacts and holds said conducting portion of said antenna in a movable manner, said antenna includes an extended portion extending out of said fixing member, and said power feed member is mounted in contact with said extended portion.

3. The antenna device according to claim 1, wherein said fixing member is a cylindrical member having a hole, and said antenna is inserted in the hole of said cylindrical fixing member.

4. The antenna device according to claim 3, wherein said power feed member contacts said antenna within the hole of said fixing member.

5. The antenna device according to claim 1, wherein said fixing member is formed from a resin.

6. A portable equipment, comprising:

a housing sized and shaped to be held by a human hand;

a linear antenna;

a fixing member formed from a dielectric and configured to hold a portion of said antenna so as to fix said antenna to said housing, said fixing member holding said antenna in a movable manner; and a power feed member contacting said antenna;

wherein said fixing member has an opening for exposing a part of a surface of the portion of said antenna that is held by said fixing member, and said power feed member contacts the part of the surface of said antenna through said opening.

7. A portable equipment, comprising:

a housing sized and shaped to be held by a human hand;

a linear antenna;

a fixing member formed from a dielectric and configured to hold a portion of said antenna so as to fix said antenna to said housing, said fixing member holding said antenna in a movable manner;

a power feed member contacting said antenna; and a substrate situated opposite to said fixing member, said power feed member provided on said substrate;

wherein said antenna includes an extended portion extending out of said fixing member within said housing, and said power feed member is mounted in contact with said extended portion.

8. The portable equipment according to claim 6, wherein said fixing member is a cylindrical member having a hole, and said antenna is inserted in the hole of said cylindrical fixing member.

9. The portable equipment according to claim 8, wherein said power feed member contacts said antenna within the hole of said fixing member.

10. A portable equipment, comprising:

a housing sized and shaped to be held by a human hand;

a linear antenna;

a fixing member formed from a dielectric and configured to hold a portion of said antenna so as to fix said antenna to said housing, said fixing member holding said antenna in a movable manner;

a power feed member contacting said antenna; and a substrate held within said housing, wherein said power feed member includes a conductor member contacting the portion of said antenna that is held by said fixing member, and being connected to said fixing member, and an electrode contacting said conductor member, and mounted on said substrate.

11. The portable equipment according to claim 6, wherein said fixing member is formed from a resin.

* * * * *